US010718104B2

(12) United States Patent
Slothower

(10) Patent No.: US 10,718,104 B2
(45) Date of Patent: Jul. 21, 2020

(54) FAUCET AND INTEGRATED TRAY

(71) Applicant: Kohler Co., Kohler, WI (US)

(72) Inventor: Anna-Pia K. Slothower, Mill Valley, CA (US)

(73) Assignee: KOHLER CO., Kohler, WI (US)

( * ) Notice: Subject to any disclaimer, the term of this patent is extended or adjusted under 35 U.S.C. 154(b) by 384 days.

(21) Appl. No.: 15/063,975

(22) Filed: Mar. 8, 2016

(65) Prior Publication Data

US 2016/0265200 A1 Sep. 15, 2016

Related U.S. Application Data

(60) Provisional application No. 62/130,497, filed on Mar. 9, 2015.

(51) Int. Cl.

| | |
|---|---|
| ***E03C 1/04*** | (2006.01) |
| ***E03C 1/042*** | (2006.01) |
| ***E03C 1/05*** | (2006.01) |

(52) U.S. Cl.

CPC ..... *E03C 1/0404* (2013.01); *E03C 1/042* (2013.01); *E03C 1/057* (2013.01)

(58) Field of Classification Search

CPC ..... E03C 1/0404; E03C 1/0412; E03C 1/042; E03C 2001/0417; E03C 1/055; F16K 31/605

USPC ... 4/628, 630, 635, 656, 677–678, 695–696; 137/342, 374, 801; 312/288.1; D23/238, D23/286, 291

See application file for complete search history.

(56) References Cited

U.S. PATENT DOCUMENTS

| | | | | |
|---|---|---|---|---|
| 925,325 | A * | 6/1909 | Gavin | A47K 1/02 4/630 |
| D50,631 | S | 4/1917 | Reid, Jr. | |
| 1,578,934 | A | 3/1926 | Stern | |
| D82,360 | S | 10/1930 | Albert | |
| 2,031,679 | A * | 2/1936 | Tjaarda | E03C 1/042 137/342 |
| D147,404 | S | 9/1947 | Fitter | |
| D149,388 | S | 4/1948 | Stratmore | |
| D153,907 | S | 5/1949 | Smolensky | |
| 3,451,068 | A * | 6/1969 | Phillips, Jr. | A47K 1/02 312/228 |

(Continued)

FOREIGN PATENT DOCUMENTS

| | | |
|---|---|---|
| CH | 411729 A | 4/1966 |
| CN | 2704307 | 6/2005 |

(Continued)

OTHER PUBLICATIONS

European Search Report for Application No. 16159505.3 dated Jul. 15, 2016, 8 pages.

*Primary Examiner* — David P Angwin
*Assistant Examiner* — Nicholas A Ros
(74) *Attorney, Agent, or Firm* — Foley & Lardner LLP

(57) ABSTRACT

A faucet that includes a body, a tray, a valve, and a spout. The body includes a plurality of interconnected walls forming an internal cavity, with the plurality of walls comprising a front wall. The tray is provided on top of the body and extends beyond the front wall. The valve is provided in the cavity and is configured to control the flow of water through the faucet. The spout extends through the front wall and is provided underneath the tray. The spout is also fluidly connected to the valve to receive water therefrom.

20 Claims, 6 Drawing Sheets

(56) References Cited

U.S. PATENT DOCUMENTS

| | | | | | |
|---|---|---|---|---|---|
| 3,451,738 | A | | 6/1969 | Hobson | |
| 3,508,282 | A | * | 4/1970 | Phillips, Jr. | A47K 1/04 4/628 |
| 4,735,357 | A | * | 4/1988 | Gregory | E03C 1/057 137/801 |
| 4,823,414 | A | | 4/1989 | Piersimoni et al. | |
| 4,991,241 | A | * | 2/1991 | Bergmann | E03C 1/04 4/619 |
| D318,320 | S | | 7/1991 | Zerlia | |
| 5,062,164 | A | | 11/1991 | Lee et al. | |
| 5,369,818 | A | * | 12/1994 | Barnum | E03C 1/01 4/623 |
| 5,504,950 | A | | 4/1996 | Natalizia et al. | |
| 6,206,340 | B1 | | 3/2001 | Paese et al. | |
| 6,212,708 | B1 | * | 4/2001 | Mulaw | A47B 77/06 4/656 |
| D493,210 | S | * | 7/2004 | Citterio | D23/238 |
| D509,564 | S | | 9/2005 | Jorgensen et al. | |
| D511,821 | S | | 11/2005 | Loberger et al. | |
| D514,664 | S | * | 2/2006 | Starck | D23/238 |
| D527,085 | S | | 8/2006 | Loberger et al. | |
| D528,637 | S | | 9/2006 | Massaud | |
| D529,133 | S | | 9/2006 | Massaud | |
| D529,134 | S | | 9/2006 | Massaud | |
| D530,782 | S | | 10/2006 | Starck | |
| D534,989 | S | | 1/2007 | Massaud | |
| D536,767 | S | * | 2/2007 | Massaud | D23/238 |
| D539,400 | S | | 3/2007 | Loberger et al. | |
| D540,912 | S | | 4/2007 | Qing | |
| D573,230 | S | | 7/2008 | Sieger | |
| 7,406,722 | B2 | | 8/2008 | Fukuizumi et al. | |
| D580,524 | S | | 11/2008 | Starck | |
| 7,575,025 | B2 | * | 8/2009 | Fleischmann | E03C 1/04 137/625.4 |
| D599,596 | S | | 9/2009 | Ghiorghie | |
| D610,242 | S | | 2/2010 | Loberger et al. | |
| D614,273 | S | | 4/2010 | Loberger et al. | |
| D617,877 | S | | 6/2010 | Bouroullec et al. | |
| D622,360 | S | | 8/2010 | Bouroullec et al. | |
| D628,280 | S | | 11/2010 | Loberger et al. | |
| D637,844 | S | | 5/2011 | Kraemer | |
| 7,946,504 | B2 | * | 5/2011 | Shapira | G05D 23/1393 137/897 |
| D641,842 | S | | 7/2011 | Loberger et al. | |
| D646,365 | S | | 10/2011 | Parekh | |
| 8,296,875 | B2 | * | 10/2012 | Loberger | E03C 1/057 4/623 |
| D676,530 | S | | 2/2013 | Kwok | |
| D677,364 | S | | 3/2013 | Schoenherr et al. | |
| D677,365 | S | | 3/2013 | Schoenherr et al. | |
| D692,535 | S | | 10/2013 | Kington et al. | |
| D708,712 | S | | 7/2014 | Yu | |
| 8,857,786 | B2 | | 10/2014 | Bayley et al. | |
| 2014/0359935 | A1 | * | 12/2014 | Veros | E03C 1/055 4/677 |

FOREIGN PATENT DOCUMENTS

| | | | | | |
|---|---|---|---|---|---|
| CN | 201748009 | | | 2/2011 | |
| CN | 202672249 | | | 1/2013 | |
| CN | 103669496 | | | 3/2014 | |
| CN | 103799720 | | | 5/2014 | |
| CN | 103975112 | | | 8/2014 | |
| DE | 3230848 | A1 | | 2/1984 | |
| EP | 2492555 | | * | 8/2012 | E03C 1/04 |

* cited by examiner

FAUCET AND INTEGRATED TRAY

CROSS REFERENCE TO RELATED APPLICATIONS

This application claims the benefits of and priority to U.S. Provisional Patent Application No. 62/130,497, filed on Mar. 9, 2015, the entire disclosure of which is incorporated herein by reference.

BACKGROUND

This application relates generally to the field of faucets for use with sinks. More specifically, this application relates to faucets having integrated trays.

SUMMARY

One embodiment relates to a faucet for a sink that includes a body, a tray, a valve, and a spout. The body includes a plurality of interconnected walls forming an internal cavity, with the plurality of walls comprising a front wall. The tray is provided on top of the body and extends forward beyond the front wall. The valve is provided in the cavity and is configured to control the flow of water through the faucet. The spout extends forward from the front wall and below/underneath the tray. The spout is also fluidly connected to the valve to receive water therefrom.

Another embodiment relates to a faucet for a sink that is mountable to a countertop. The faucet includes a body, a tray, a spout, a valve, and a lever. The body is configured to mount to the countertop and/or the sink. The tray is provided above and coupled to the body. The tray has a planar support surface that is larger than a cross-sectional area (e.g., a horizontal cross-sectional area, such as the largest horizontal cross-sectional area) of the body. The spout extends from a front side of the body below the tray for directing water from the faucet. The valve is in the body and configured to control a flow of water to the spout, and the lever is configured to control operation of the valve upon movement of the lever. The lever may, for example, extend between the body and the tray.

Yet another embodiment relates to a faucet for a sink assembly that includes a sink, a support member supporting the sink, and a drain mechanism movable between an open position and a closed position. The faucet includes a structure having a base, a tray, and an outlet. The base is configured to mount to the sink and/or the support member. The tray extends from an upper end of the base such that a forward edge of the tray extends beyond a forward edge of the base. The outlet is configured to direct water from the structure. The faucet also includes a valve for controlling a flow of water to the spout, a first sensor located at a first location on or in the structure for turning on and off the valve upon detection of an object in a zone of detection, and a second sensor located at a second location on or in the structure for moving the drain mechanism between the open position and the closed position.

DETAILED DESCRIPTION

Referring generally to the Figures, disclosed herein are various embodiments of faucets having integrated trays (e.g., shelves, accessory trays, platforms, tops, supports, upper portion, etc.) disposed on top of bodies of the faucets to provide utility, such as to support objects (e.g., soap, soap dispensers, toiletries, etc.) placed on the shelves. The faucets may also include spouts through which fluid (e.g., water) flows. The spouts may be located below the integrated trays or integrated therewith. The faucets may also include a control device (e.g., a handle, a lever, a switch, etc.) configured to control operation of a valve, which may be provided within the faucet (e.g., a body thereof) or located externally thereto. The faucets may also include one or more sensors configured to control operation of the faucet (e.g., a flow rate of fluid, a temperature of fluid) and/or operation of a drain (e.g., a drain stopper, a drain assembly) of a sink, which the faucet is associated with.

Figure 1:
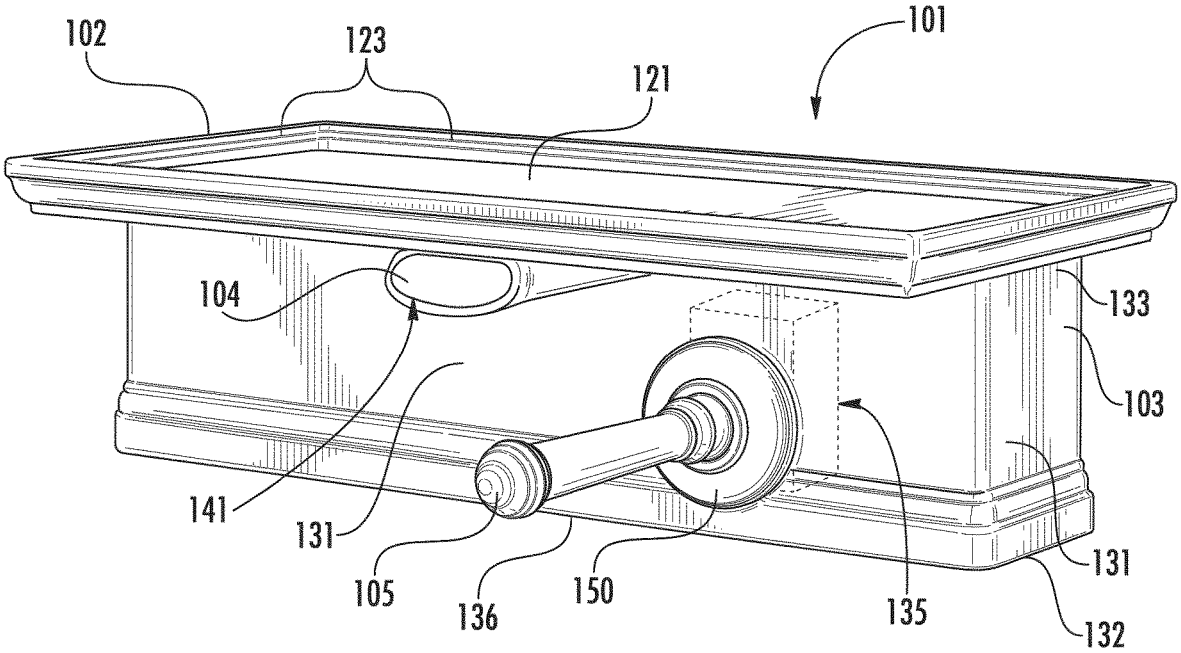
FIG. 1 is a perspective view of an exemplary embodiment of a faucet.
Figure 2:
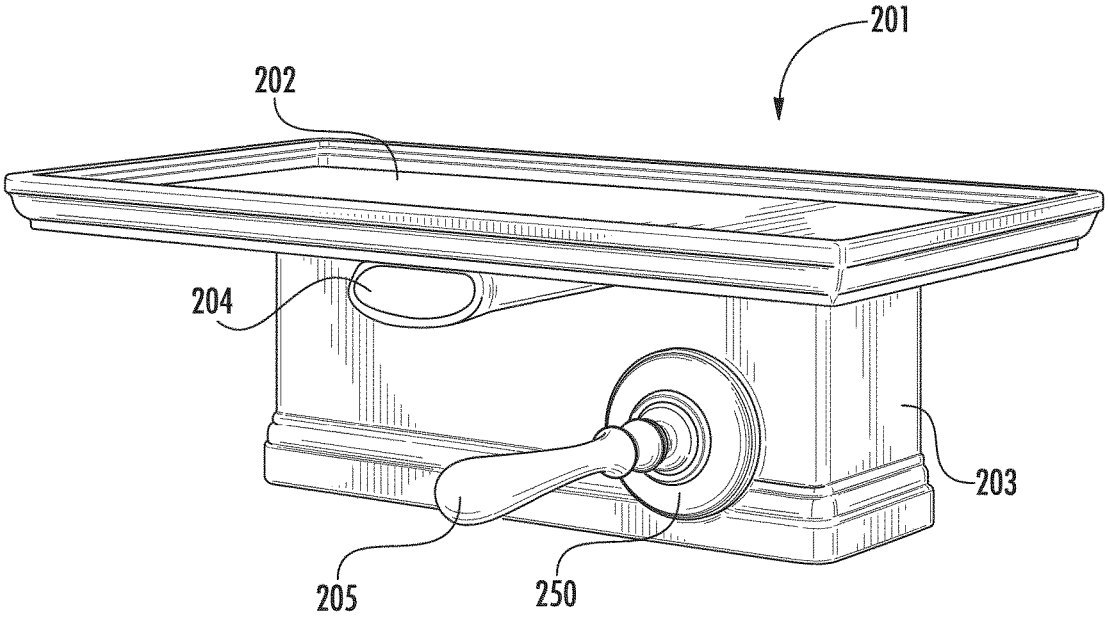
FIG. 2 is a perspective view of another exemplary embodiment of a faucet.
Figure 3:
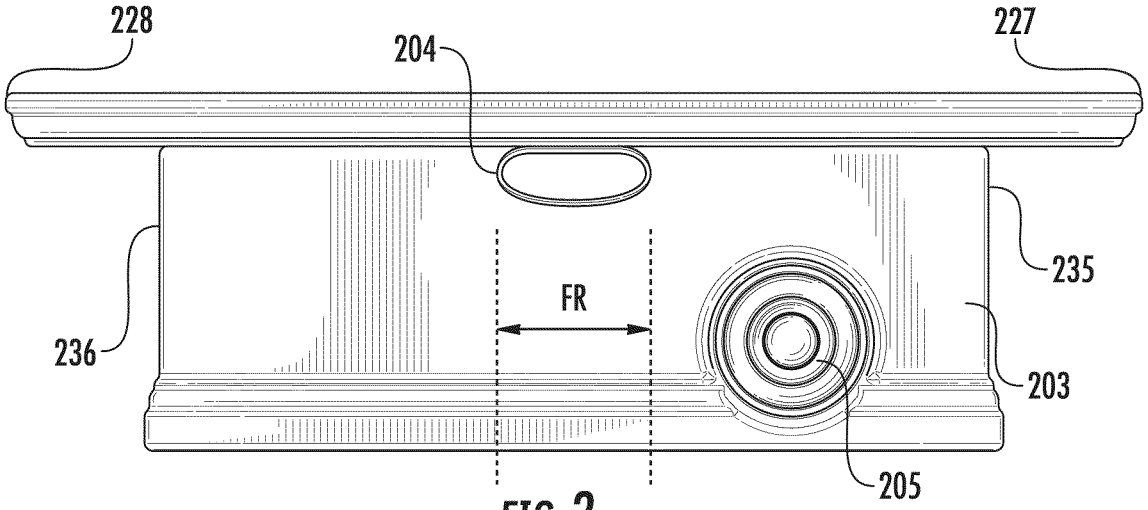
FIG. 3 is a front view of the faucet of FIG. 2.
Figure 4:
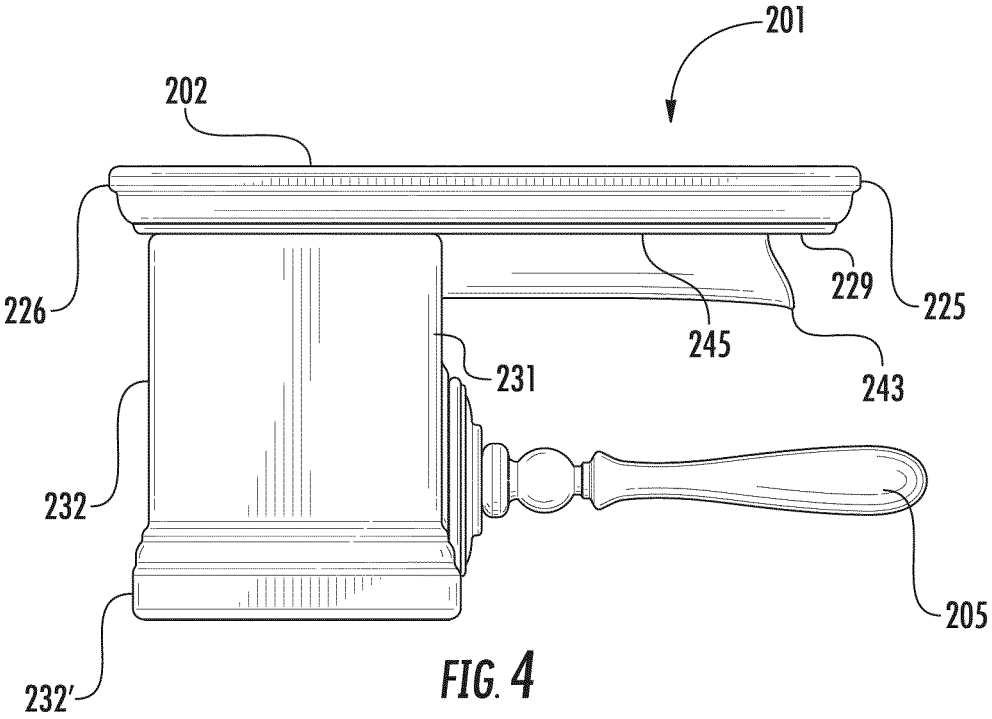
FIG. 4 is a side view of the faucet of FIG. 2.
Figure 5:
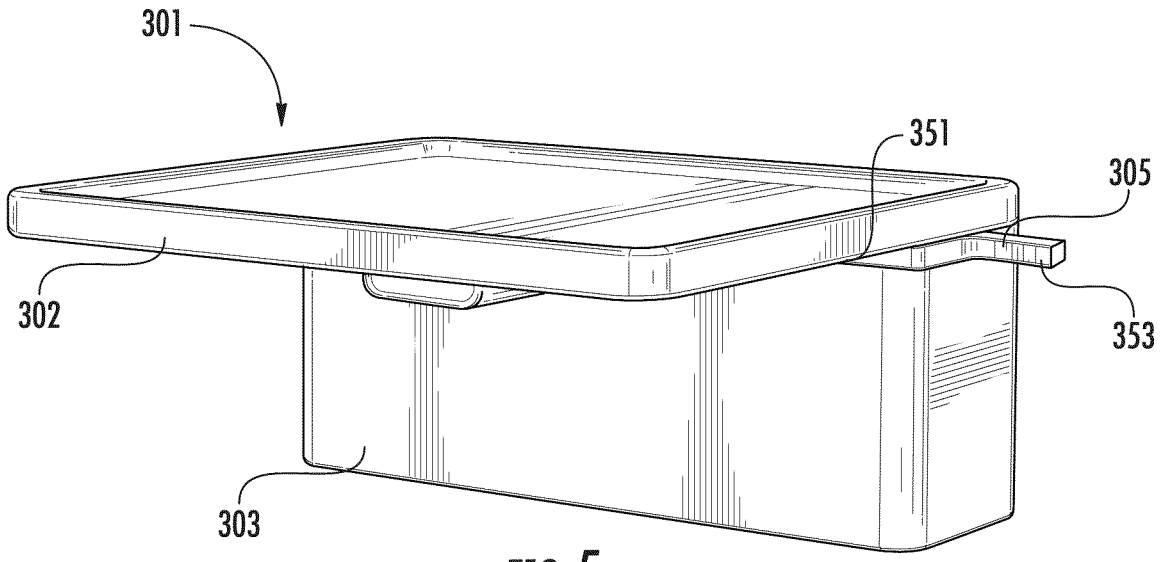
FIG. 5 is a perspective view of another exemplary embodiment of a faucet.
Figure 6:
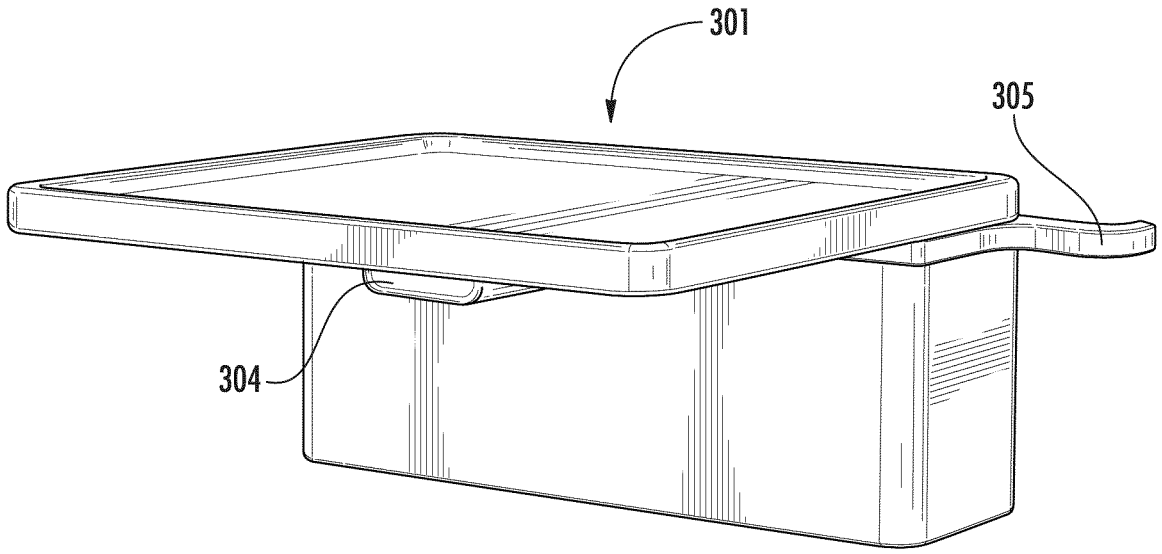
FIG. 6 is another perspective view of the faucet of FIG. 5.

FIG. 1 illustrates one non-limiting example of a faucet 101 having a tray 102 integrated with a body 103 (e.g., base, bottom, lower portion, etc.). Together the body 103 and the tray 102 may form a structure of the faucet 101. FIGS. 2-4 illustrate another example of a faucet 201 having a tray 202 integrated with a body 203. The integrated trays (e.g., tray 102, 202) may be integrally formed with their associated bodies (e.g., body 103, 203) or may be formed separately and coupled (e.g., directly coupled) thereto. Thus, the structure may be a unitary structure when the tray is integrally formed with the base. The faucet 201 is similar to the faucet 101, except that it is configured having a different size (e.g., a larger/smaller width, a larger/smaller depth, a taller/shorter height, etc.) and includes a differently configured handle. Therefore, the description of the elements (e.g., the tray, the body, the spout, the handle, etc.) of one of the faucets 101, 201 may also be applied to the corresponding element of the other faucet, except where noted to be different. It is noted that the faucets may be configured having differently configured spouts (e.g., shapes thereof).

Figure 10:
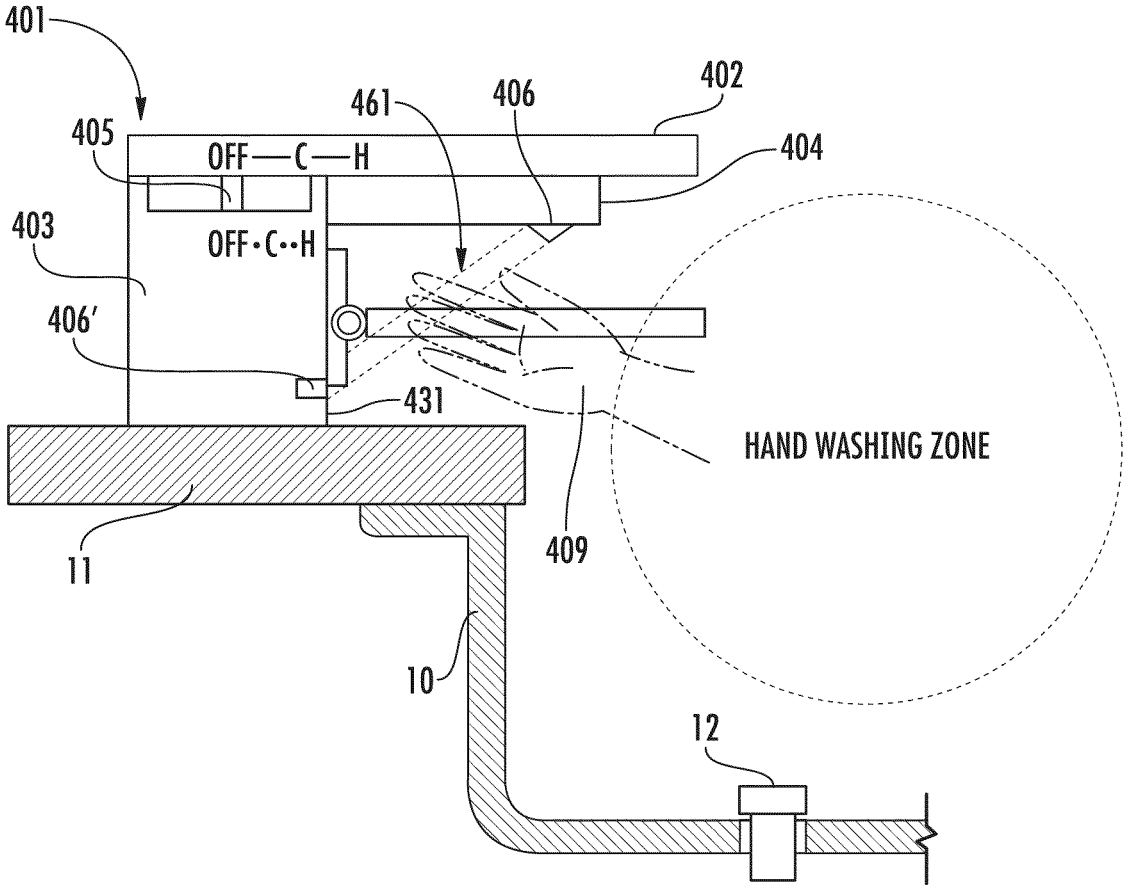
FIG. 10 is a side view of a faucet including a sensor configured to control the operation of a valve and the flow of water from a spout.

The body 103 of the faucet 101 includes one or more walls 131 (e.g., sides, ends, etc.) forming, for example, a generally cuboidal shape. As shown in FIG. 1, the body 103 includes a plurality of interconnected walls 131 that together form an internal cavity between the walls. For example, the body 103 may include a front wall, one or more than one side wall (e.g., a right lateral side wall, a left lateral side wall), and a rear wall. The plurality of walls may be integrally formed out of, for example, a common material, such as a vitreous China material or any other suitable material (e.g., metal, glass, plastic, composite, etc.), or may be formed separately then coupled together. Each wall 131 may include a bottom portion 132 (e.g., a bottom surface, a foot, etc.) configured to rest on another object, such as a sink 10, a countertop 11 (as shown in FIG. 10), a combination thereof, or any other suitable object or combination of objects. Each wall 131 may include a top portion 133 (e.g., a top surface) configured to support the tray 102, such as when the tray is separately formed from the body and placed on top of and/or coupled to the associated body. Each top portion of each wall 131 is located above the associated bottom portion of the wall, and the top portion may be directly coupled to the associated tray, such as when the tray and body are integrally formed together.

The body 103 may be configured to house (e.g., contain) other elements/components of the faucet 101. For example, the faucet 101 may include a valve 135 (shown in FIG. 1 using dashed lines since the valve is provided within the body 103) that is configured to control a flow of water through the faucet 101. The valve may be contained within the body 103, such as the internal cavity defined (e.g., formed) by the plurality of interconnected walls of the body 103. Also for example, the body 103 may house or support one or more sensors located on or within the body. Also for example, the body 103 may support or contain other elements/components of the system, such as a control device (e.g., handle, lever, etc.) configured to control operation of a valve. The sensors and control devices are discussed in more detail below.

The tray 102 of the faucet 101 is provided above the body 103. As shown in FIG. 1, the tray 102 includes a surface 121 (e.g., an upper surface, a support surface, etc.) that is configured to support other objects (e.g., soap, soap dispensers, toiletries, etc.) placed on the surface 121. The surface 121 may be flat, curved, crowned, or have any suitable shape. For example, the support surface 121 may be planar (e.g., horizontal) and/or have a size (e.g., a horizontal surface area) that is larger than a size (e.g., a horizontal cross-sectional area) of the body 103. The tray 102 may extend forward of a front wall 131 and/or a front edge 136 of the body 103 and/or extend laterally beyond a side wall and/or edge of the body 103. The term "forward" (or equivalent term) is generally used herein to denote the direction/side the spout/outlet of the faucet faces or is located. For example, the tray 102 may be configured to extend laterally beyond two opposite sides of a spout (e.g., the spout 104) and beyond a forward edge of the spout, such that the entire spout is covered (e.g., concealed) by the tray 102. By having a larger size and/or extending beyond the body, the tray 102 (e.g., the surface 121) may advantageously provide increased utility to store objects on the support surface while concealing the body, other elements/components of the faucet, and/or portions thereof.

The tray 102 may include a marking, such as a monogram (e.g., a "K") to denote a name (e.g., manufacturer, purchaser, etc.) or a pattern to change or modify the aesthetics. For example, the support surface 121 of the tray 102 may include such a marking. The tray 102 may include a lip 123 (e.g., projection, protrusion, etc.) that extends upwardly from the surface 121. The lip 123 may extend around the entire periphery (e.g., outer profile) of the surface 121, as shown in FIG. 1, or the lip 123 may extend around a portion of the surface 121.

The tray 102 may be made from a vitreous China material (i.e., "vitreous material"), a metal (e.g., chrome, brass, etc.), a combination thereof, or any other suitable material (e.g., glass, plastic, composite, etc.). For example, the tray 102 may be made from a vitreous material, which may be integrally formed with the body 103 or formed separately from the body 103 and then coupled thereto. Also, for example, the tray 102 may include a metal (e.g., chrome or brass) portion that is integrated with a vitreous portion of the tray 102 and/or the body 103. The tray 102 could be another type of material, color, texture, etc.

The faucet 101 includes an outlet through which water is directed from the faucet 101. The outlet may include a single opening (e.g., aperture, nozzle, etc.) or a plurality of openings. The outlet may direct the water as a flow of water, as a spray pattern of water, any other suitable arrangement, or any combination thereof. The outlet may be located in a spout, in a tray, or in a body of the faucet.

Also shown in FIG. 1, the faucet 101 includes a spout 104 configured to discharge (e.g., emit, output, etc.) a flow of fluid (e.g., water) from the faucet, such as through an outlet. The spout 104 may extend through a wall of the body 103 of the faucet 101. For example, the front wall 131, 231 may include an opening through which the spout 104, 204 extends. The spout 104 may be configured to extend up to the wall of the body 103 of the faucet 101, such as to couple to the front wall 131 of the body. For example, the end of the spout 104, which is opposite the end including the nozzle(s), may abut an outside of the front wall 131. The front wall 131 may include an opening through which the spout 104 is fluidly connected to the valve 135 or other internal element/component of the faucet.

The spout 104 may be provided underneath the tray 102. The spout 104 may extend (e.g., in a forward direction) beyond a forward edge of the tray (e.g., the forward edge 225 shown in FIG. 4), or alternatively, the tray may extend beyond a forward edge of the spout (e.g., the forward edge 243 shown in FIG. 4). For the latter, the spout may be concealed (e.g., partially, fully) by the tray, such as when a user is standing over the faucet. According to one example, the spout 204 is coupled to (e.g., abuts) the tray 102. For example, an upper surface 245 (see FIG. 4) of the spout 204 may be configured to abut/contact a lower surface 229 of the tray 202. The spout and the tray may be integrally formed together or may be formed separately and then coupled together.

The tray 202 may include a rearward edge 226, which may extend (e.g., in a rearward direction) beyond a rear surface 232 of the body 203 (or 232' such as where the bottom portion 132 extends the farthest rearward), as shown in FIG. 4. Similarly, the tray 202 may include a first (e.g., right) side edge 227 and a second (e.g., left) side edge 228, where the first side edge 227 extends outwardly beyond a first side 235 of the body 203 and the second side edge 228 extends outwardly beyond a second side 236 of the body 203, as shown in FIG. 3. Alternatively, each edge (e.g., rearward, side) of the tray 202 may extend up to the associated surface of the body 203, such as the rear surface and/or side surfaces.

The spout 104 may be configured as a hollow member (e.g., a tube) that includes an inlet end (not shown) and an outlet end 141, from which the fluid (e.g., water) passing through the faucet exits. The inlet end of the spout 104 is fluidly connected to a valve (e.g., the valve 135), which may be provided in the cavity of the body 103, such that the spout 104 receives the flow of fluid from the valve. Providing the valve within the body of the faucet may advantageously make installation of the faucet easier and quicker, since there would be fewer components to install compared to a faucet having an external valve. The spout may be integrated with the tray to form a passageway (e.g., a flow cavity, flow channel, etc.) that water is configured to flow within.

According to another exemplary embodiment, the outlet is located in (e.g., integrated with) the tray. For example, the outlet 504 (e.g., water flow outlet) may be located in a forward side of the tray that faces in an opposite direction from a rear side of the structure, such as the front face 525 of the tray 502 shown in FIG. 11. As another example, the outlet may be located in a bottom side of the tray that faces in a generally downward direction, such as in the front, bottom portion 324' of the tray 302 shown in FIG. 8. The outlet may be located in other places on the faucet according to other examples.

The faucet may include a control device (e.g., a handle, a lever, a switch, etc.) that is configured to allow a user to control operation of a valve through manipulation of the control device. The control device may be electronically controlled (e.g., using a touch sensitive panel) or manually controlled (e.g., handle, lever, switch, etc.). As shown in FIG. 1, the faucet 101 includes a handle 105 that is configured to control operation of the valve. As shown in FIGS. 1-4, each handle (e.g., handle 105, 205, etc.) may extend outwardly (in a forward direction) from the front wall 131, 231 of the body 103, 203. Each handle (e.g., handle 105, 205, etc.) may be provided below the associated tray (e.g., tray 102, 202, etc.) such as in close proximity to the associated spout (e.g., spout 104, 204, etc.) to provide improved ergonomics for the user of the faucet.

The handle 105 may be connected, such as through a linkage or other mechanism, to the valve, such that manipulation of the handle 105 by a user of the faucet 101 controls the operation of the valve. For example, a first manipulation (e.g., a first rotation, a first translation, etc.) may control (e.g., increase, decrease, etc.) a flow rate of the fluid flowing through the valve (and to the spout). Also, for example, a second manipulation (e.g., a second rotation, a second translation, etc.) may control a temperature of the fluid flowing through the valve. Thus, a single handle may be used to control both the flow rate and the temperature control of the faucet (or may control one of the flow rate and the temperature). A faucet having only a single handle may advantageously reduce the number of components, which may reduce cost, and simplify use of the faucet by allowing a user to control the faucet with only a single hand.

The handle 105, 205 may be offset from and/or parallel to the spout 104, 204, such as, for example, to locate the handle 205 outside of a flow region FR (see FIG. 3) of fluid exiting from the spout 204. As shown in FIG. 3, the spout 204 may be located approximately centrally along a width of the body 203 (e.g., in a lateral direction) and the handle 205 may be located offset from the approximate central location to one side (e.g., right-side, left-side). Advantageously, the handle 205 may be located just outside the flow region FR of the fluid, such that fluid from the spout 204 does not flow over the handle (or, for example, a user's hand while operating the handle 205). However, the close proximity between the handle and the spout (e.g., locating the handle just outside the flow region of the spout) may advantageously allow the user to adjust the flow rate and/or temperature of the fluid with minimal movement or effort to improve the ergonomics of the faucet.

The faucet 101, 201 may include an escutcheon 150, 250 as shown in FIGS. 1 and 2, which may change or modify the aesthetics of the faucet. The escutcheon may be coupled to the handle. The escutcheon 150 may be configured to cover a portion of the handle 105, such as a base. The handle may be configured to extend from the escutcheon. The escutcheon 150 may be coupled to the body 103 and/or the valve within the body, such as to retain (e.g., secure) the handle 105 (e.g., the base of the handle) in place relative to the body and/or the valve.

Figure 7:
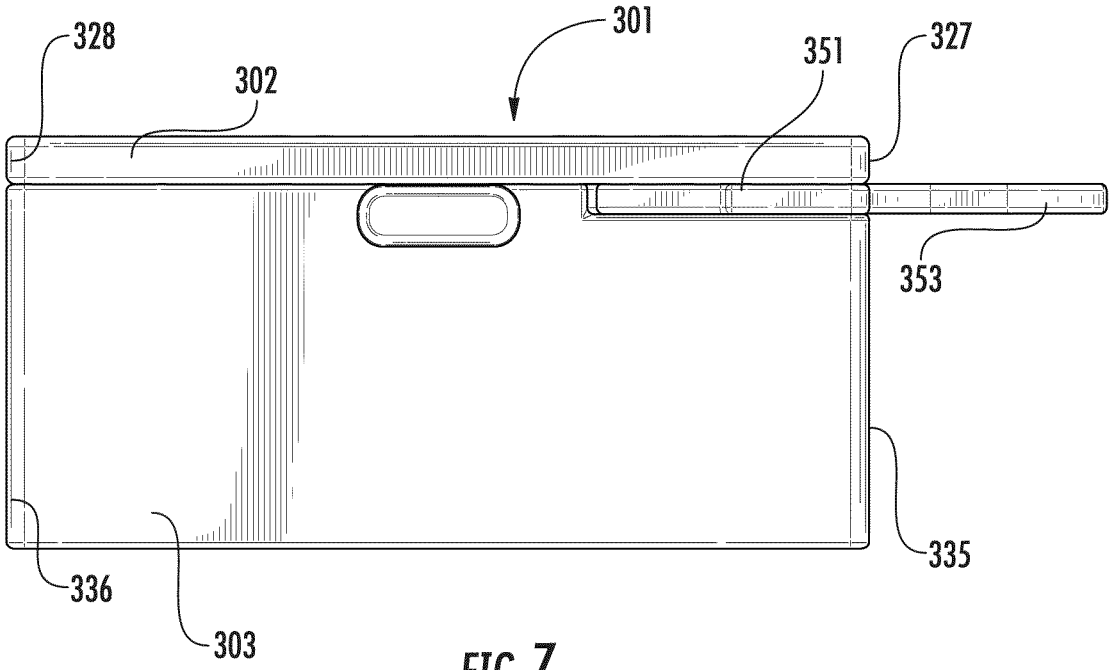
FIG. 7 is a front view of the faucet of FIG. 6.
Figure 8:
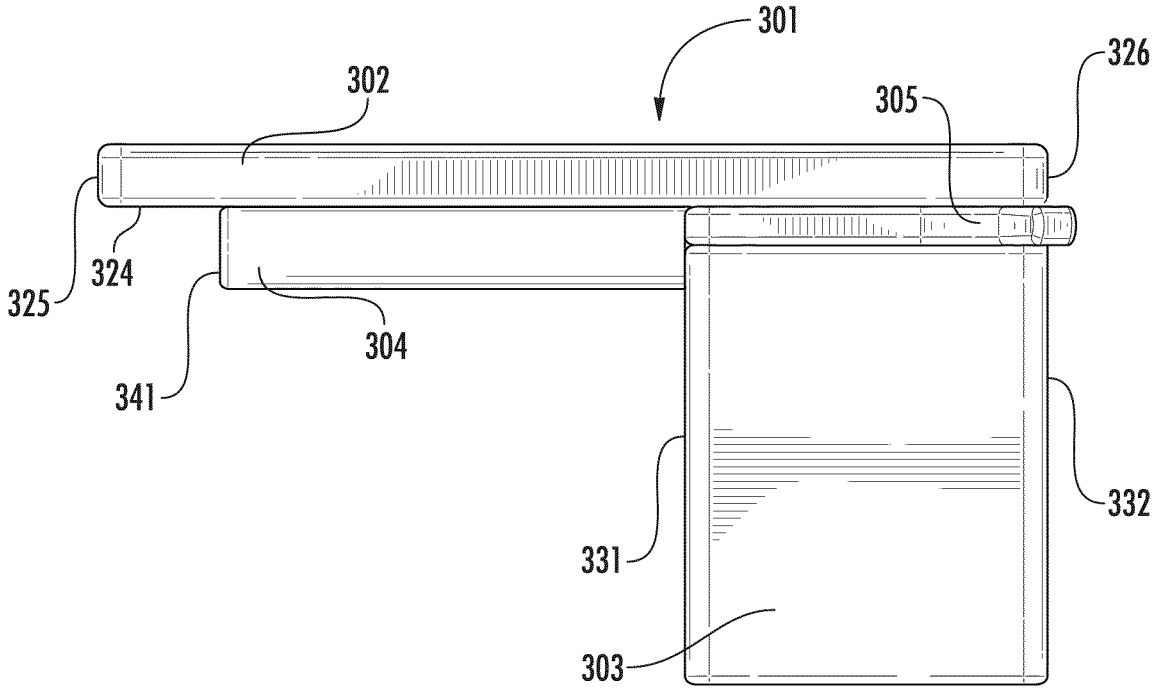
FIG. 8 is a side view of the faucet of FIG. 6.
Figure 9:
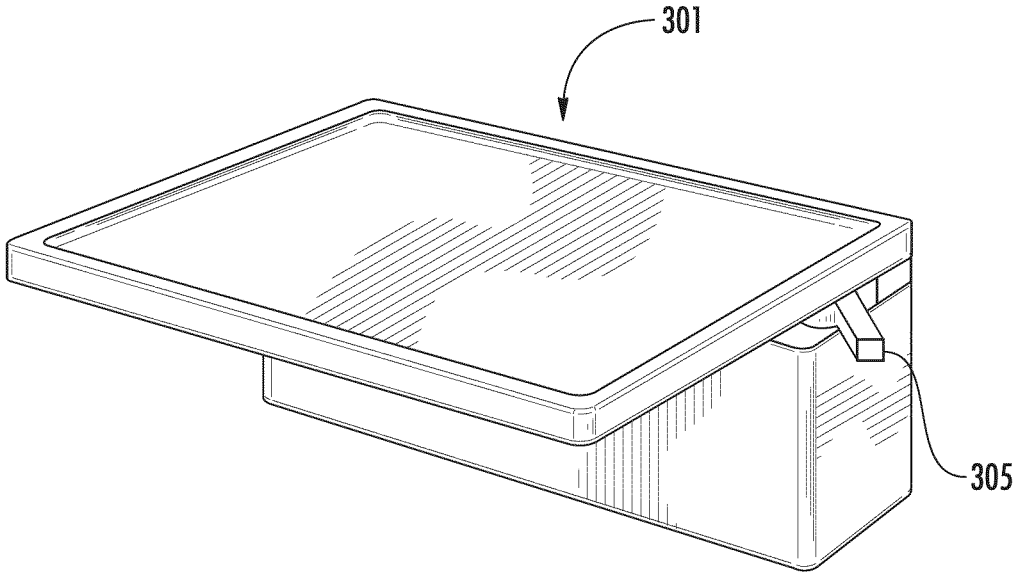
FIG. 9 is another perspective view of the faucet of FIG. 5, shown with the control lever in an open position.

FIGS. 5-9 illustrate another example of a faucet 301 including an integrated tray 302 disposed on top of a body 303, a spout 304 extending from the body 303, and a control lever 305 configured to control operation of a valve (e.g., a valve contained completely within the body 303). The tray 302 extends beyond a front wall 331 of the body 303 and/or a front edge 341 of the spout 304. For example, a front surface 325 of the tray 302 is provided forward of both the front wall 331 and the spout 304, as shown in FIG. 8. Also shown in FIG. 8, a rear wall 332 of the body 303 is approximately flush with a rear surface 326 of the tray 302. As shown in FIG. 7, a first side wall 335 of the body 303 is approximately flush with a first side surface 327 of the tray 302, and a second side wall 336 of the body 303 is approximately flush with a second side surface 328 of the tray 302.

The control lever 305 is configured to control operation of a valve associated with the faucet 301. The control lever 305 may be provided between the tray 302 and the body 303, such as portions thereof. For example, the control lever 305 may be rotatably disposed between an upper portion of the body 303 and a lower portion of the tray 302. As shown, the control lever 305 is configured to rotate or pivot about a base 351 having a pivot axis. The base 351 of the control lever 305 may be pivotally (e.g., rotatably) coupled to the body 303 and/or the tray 302. The control lever 305 also includes an arm 353 that extends outwardly from the base 351 to facilitate rotation of the control lever 305.

According to an exemplary embodiment, the control lever 305 is configured to control the flow and temperature of the fluid flowing through the valve, such as by adjusting the flow from a cold water inlet and/or a hot water inlet. The control lever 305 may include a first position corresponding to a closed position, in which the valve is closed and no water flows from the faucet (e.g., the spout). The control lever 305 may be moved (e.g., rotated) to a second position corresponding to an open position, in which the valve is open and water flows from the spout of the faucet. The second position of the control lever 305 may correspond to a first given temperature, such as, for example, a maximum cold position, in which all of the fluid flowing from the spout is from the cold water inlet. The control lever 305 may be moved (e.g., rotated) to a third position corresponding to the open position and a second given temperature, such as, for example, a maximum hot position (e.g., the hottest temperature setting). The control lever 305 may be adjustable into intervening positions provided between the second and third positions (e.g., the position of the control lever 305 shown in FIG. 9) to adjust the temperature incrementally, such as from colder to hotter settings as the lever is moved from the second position toward the third position. In other words, rotation of the control lever 305 from the second position to the third position may change the temperature (e.g., to be hotter, to be colder) of the fluid exiting the valve, such as by adjusting the flow rates from the cold water inlet and/or the hot water inlet. The various intervening lever/valve positions may correspond to varying degrees of temperature of the water flowing through the valve and from the spout. Thus, the control lever 305 may be configured to control turning on and off the water flow, as well as the temperature of the water flow. As a non-limiting example, the flow rate of the water may be between 1.0 and 1.5 gpm, when the lever is positioned anywhere from the second position to the third position.

As noted, the control lever 305 may be rotatable between first and third positions, such as in the second position. According to one exemplary embodiment, the control lever 350 is configured to provide an angle of travel between the first and third positions of the control lever 305 that is less than 180° (i.e., between 0° and 180°). For example, the angular rotation of the control lever 305 between the closed position and the open maximum temperature position of the valve may be 180°. According to another exemplary embodiment, the control lever 350 is configured such that the angle of travel between the first and third positions of the control lever is less than 90° (i.e., between 0° and 90°). For example, the angular rotation of the control lever 305 between the closed position and the open maximum temperature position of the valve may be 90°. The rotation from the first position to the second position may be relatively small compared to the total rotational travel of the lever (e.g., less than 30°, less than 15°, etc.).

It is noted that the control lever 305 may, for example, be configured to control both the flow rate and the temperature of the water flowing from the faucet (e.g., the spout). Also, for example, the system may include a second control mechanism (e.g., handle, switch, etc.) that is separate from the lever 305 for controlling the flow rate of water flowing through the faucet. The faucet may include a switch, such as a slide switch or rheostat device, or another control lever, whereby a movement (e.g., displacement) of the switch/lever in a first direction increases the flow rate of the fluid and movement of the switch/lever in a second direction opposite the first direction decreases the flow rate of the fluid. For example, the faucets of this application may be configured to include a control lever (e.g., the control lever 305, handle, etc.) and an actuator (e.g., switch, such as the slide switch 405 shown in FIG. 10, a knob). The control lever may be configured to rotate to control one of the flow rate and the temperature of the fluid flowing through the valve; and the switch may be configured to move (e.g., slide) to control the other of the flow rate and the temperature of the fluid flowing through the valve.

According to another exemplary embodiment, the control lever 405 is slidable between a first position in which the water leaving the spout has a maximum cold temperature, a second position in which the water leaving the spout has a maximum hot temperature, and a plurality of intermediate positions between the first position and the second position. Each intermediate position corresponds to a temperature that is between the maximum cold and the maximum hot temperatures. Each successive intermediate position (e.g., moving toward the second position from the first position) may successively increase the temperature of the water. The lever 405 may include an off position (corresponding to the valve being closed and prohibiting water from flowing from the faucet), which may be located adjacent to the first position or the second position, such as opposite the intermediate positions if provided. The lever 405 may be located on a lateral side of the body 403 or the tray 402 that is substantially orthogonal to a front side of the body 403 or the tray 402.

According to another exemplary embodiment, the control lever 305 is provided between the tray 302 and the body 303 and is rotatable between a first position, in which the valve is closed, and a second position, in which the valve is open (e.g., full-open). An angle of travel (e.g., rotation) between the first position and the second position of the control lever 305 for this example may be equal to or less than 90° (ninety degrees).

According to yet another exemplary embodiment, the control lever 305 extends between the body 303 and the tray 302 and is rotatable about the body 303 and the tray 302 between a first position, in which the valve is in a closed position, a second position, in which the valve is in an open position and the water leaving the spout has a first temperature (e.g., cold water), and a third position, in which the valve is in the open position and the water leaving the spout has a second temperature (e.g., hot water) that is different than the first temperature. The lever 305 may extend outwardly from a lateral side of the body 303, such that the lever 305 rotates in a plane that is parallel to the planar support surface of the tray. The second position may be located between the first position and the third position. An angle of travel between the first position and the third position of the lever may be equal to or less than 180°. The angle of travel may be equal to or less than 90° according to other examples.

The faucets, as disclosed in this application, may be configured to include one or more sensors. As shown in FIG. 10, the faucet 401 includes a sensor 406 configured to control operation of the valve upon detection of an object (e.g., the hand 409) positioned within a zone of detection. For example, the sensor 406 may turn the valve on and off upon each detection of an object within a zone of detection 461. In other words, a first detection by the sensor 406 opens the valve and turns the faucet on, such that water flows from the spout 404; and a second, subsequent detection by the sensor 406 closes the valve and turns the faucet off, such that water no longer flows from the spout 404. The zone of detection may, for example, be located underneath the spout 404, forward of a front wall/edge of the body 403, and/or rearward of the outlet (e.g., the exit of the spout) through which water leaves the faucet.

The sensor 406 may be positioned in or on the spout 404. As shown in FIG. 10, the sensor 406 is positioned near the end of the spout 404 (e.g., proximate the outlet or exit of the spout, underneath a forward end of the spout, along a front wall, etc.). The sensor 406 may be aligned at an oblique angle relative to the spout 404, body 403, horizontal or vertical. As shown, the sensor 406 is aligned with a portion of the body 403, such as a lower portion of the front wall of the body. The sensor 406 may emit a beam (e.g., an infrared or IR beam, an electromagnetic beam, a microwave beam, an acoustic beam, an optical beam, etc.) that detects the presence of an object within a zone of detection 461. The zone of detection 461 may be configured to have a generally linear shape, a generally conical shape (e.g., conical, frusto-conical, etc.), a cylindrical shape, or any other suitable shape. This arrangement may advantageously provide a zone of detection 461 of the sensor 406 that is outside a washing zone (e.g., a hand washing zone, as shown in FIG. 10) of the spout 404.

Alternatively, the sensor 406 may be positioned in or on the body 403 or a portion of the tray (e.g., in or on the underside of the tray). For example, the sensor 406' may be positioned within the body 403 at a lower location along the front wall 431. The sensor 406' may emit a beam that detects the presence of an object within a zone of detection. It is noted that a sensor (e.g., a valve control sensor) may be positioned at other locations of the faucet. According to another exemplary embodiment, a sensor of the faucet may include a transmitter and a receiver, where the transmitter emits a signal (e.g., beam) that the receiver receives, and the sensor controls operation of the valve/drain assembly upon a break in the signal (e.g., by an object passing through the zone of detection). For this example, the transmitter may be one of the sensor 406 and the sensor 406' and the receiver may be the other of the sensor 406 and the sensor 406'.

Figure 11:
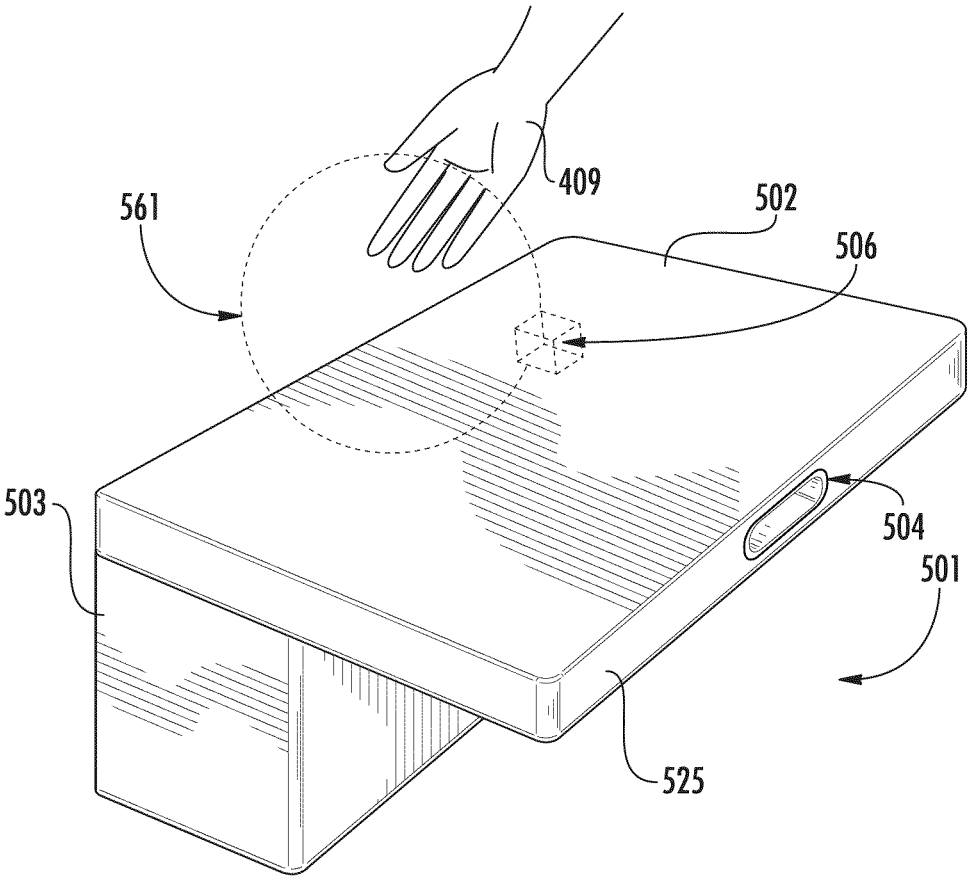
FIG. 11 is a partial perspective view of a faucet including a sensor configured to control the operation of a drain of a sink.

The faucets as disclosed in this application may include a sensor that is configured to control operation of a drain of a sink, such as, for example, the drain mechanism 12 (e.g., drain stopper, drain plug, etc.) shown in FIG. 10. The drain sensor may be used alone or in combination with any other sensors disclosed herein. The drain sensor may be configured to control opening and closing of the drain mechanism 12 upon activation (e.g., presence in a zone of detection of the associated sensor). The sensor 506 may be located on or within the body 503, on or within the tray 502, or remotely from the faucet altogether. As shown in FIG. 11, the faucet 501 includes a sensor 506 that is configured to include a zone of detection that is provided behind the faucet 501. For example, the sensor 506 may be located on or within a rear wall of the body 503 (e.g., the rear wall 332 shown in FIG. 8), such that a detection zone of the sensor 506 is rearward of the rear wall (e.g., behind the faucet). The rear wall may be on an opposite side of the faucet (e.g., the body) from the front wall.

The sensor 506 may emit a beam that detects the presence of an object within a zone of detection 561. Upon an object (e.g., a hand) entering the zone of detection, the sensor would move the drain to either a closed position from an open position or the open position from the closed position, depending on the position of the drain. In other words, if the drain is in the open position, then passing an object into the zone of detection of the sensor 506 would activate the drain moving it to the closed position; and if the drain is in the closed position, then passing an object into the zone of detection of the sensor 506 would active the drain moving it to the open position. Providing the sensor 506 on the rear of the faucet 501 may advantageously prohibit inadvertent actuation of the drain.

Each faucet disclosed in this application (e.g., faucets 101, 201, 301, etc.) may include one or more of the above describes sensors 406, 406', 506 to control operation of the valve and/or the drain assembly.

Each faucet may include a valve configured to control the fluid, such as the flow rate and/or temperature thereof, through the faucet. For example, the valve may be configured as a mixing valve having a first inlet (e.g., a cold water inlet) and a second inlet (e.g., a hot water inlet).

The valves described in U.S. patent application Ser. No. 13/802,163 filed on Mar. 13, 2013; Ser. No. 13/802,149 filed on Mar. 13, 2013; Ser. No. 13/802,179 filed on Mar. 13, 2013; and Ser. No. 13/802,186 filed on Mar. 13, 2013, are non-limiting examples of valves that may be used within any one or all of the faucets described herein. It is noted that other valves may be used within the faucets disclosed in this application.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., body, tray, handle, spout, lever, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet for a sink, comprising:

a body including a plurality of interconnected walls forming an internal cavity, wherein the plurality of walls comprises a front wall;

a tray provided above the body that extends forward of the front wall;

a valve provided in the cavity and configured to control a flow of water;

a spout directly coupled to the front wall below the tray, wherein the spout is fluidly connected to the valve; and a single lever extending between the body and the tray, wherein the lever is configured to control of both a temperature and a flow rate of water through the valve.

2. The faucet of claim 1, wherein the tray extends laterally beyond two opposite sides of the spout and beyond a forward edge of the spout, such that the entire spout is covered by the tray.

3. The faucet of claim 1, wherein the single lever is rotatable about the body and the tray between a first position, in which the valve is in a closed position, a second position, in which the valve is in an open position and the water leaving the spout has a first temperature, and a third position, in which the valve is in the open position and the water leaving the spout has a second temperature that is different than the first temperature.

4. The faucet of claim 1, wherein the spout includes an opening in an end, wherein the end of the spout is parallel to the front wall of the body.

5. The faucet of claim 4, wherein a front wall of the tray is parallel to the front wall of the body and the end of the spout, wherein the entire spout is concealed by the tray when the faucet is viewed from above.

6. The faucet of claim 1, wherein a left side wall of the body is coplanar with a left side wall of the tray, and a right side wall of the body is coplanar with a right side wall of the tray.

7. The faucet of claim 6, wherein a rear wall of the body is coplanar with a rear wall of the tray.

8. The faucet of claim 6, wherein the front wall of the body is parallel to and offset from a front wall of the tray.

9. The faucet of claim 8, wherein the front walls of the body and the tray are orthogonal to the left and right side walls of the body and the tray.

10. A faucet for a sink, comprising:

a body including a plurality of interconnected walls forming an internal cavity, wherein the plurality of walls comprises a front wall;

a tray provided above the body that extends forward of the front wall;

a valve provided in the cavity and configured to control a flow of water;

a spout directly coupled to the front wall below the tray, wherein the spout is fluidly connected to the valve; and movably disposed between the body and the tray, wherein movement of the single handle adjusts a flow of cold water and a flow of hot water.

11. The faucet of claim 10, wherein the lever is adjustable relative to the body in a first position, in which the valve is in a closed position, a second position, in which the valve is in an open position and the water leaving the spout has a first temperature, and a third position, in which the valve is in the open position and the water leaving the spout has a second temperature that is different than the first temperature.

12. The faucet of claim 10, wherein the lever pivotally couples to one of the body or the tray to rotate between the first, second and third positions.

13. The faucet of claim 10, further comprising:

a first sensor located at a first location on or in the body for turning on and off the valve upon detection of an object in a zone of detection; and a second sensor located at a second location on or in the body for moving a drain mechanism between an open position and a closed position;

wherein the second location of the second sensor is on or in a rear side of the body that is opposite to a front side of the body having the spout.

14. The faucet of claim 13, wherein the first location is on or in an underside of the spout, such that the zone of detection is located directly below the spout.

15. The faucet of claim 13, wherein the first location of the first sensor is on or in an underside of the tray.

16. The faucet of claim 15, wherein the body and the tray form a unitary structure.

17. A faucet for a sink that is mountable to a countertop, the faucet comprising:

a body configured to mount to the countertop or the sink;

a tray provided above and coupled to the body, the tray having a planar support surface that is larger than a horizontal cross-sectional area of the body;

a spout directly coupled to a front side of the body below the tray for directing water from the faucet such that the spout remains stationary relative to the body;

a valve in the body and configured to control a flow of water to the spout; and a lever disposed below the tray for controlling operation of the valve upon movement of the lever, wherein the lever extends between the body and the tray and is rotatable about the body and the tray between a first position, in which the valve is in a closed position, a second position, in which the valve is in an open position and the water leaving the spout has a first temperature, and a third position, in which the valve is in the open position and the water leaving the spout has a second temperature that is different than the first temperature.

18. The faucet of claim 17, wherein the lever extends outwardly from a lateral side of the body and the lever rotates in a plane that is parallel to the planar support surface of the tray, wherein the second position is located between the first position and the third position, and wherein an angle of travel between the first position and the third position of the lever is equal to or less than 90°.

19. The faucet of claim 17, wherein the lever is slidable between said second position in which the water leaving the spout has a maximum cold temperature, said third position in which the water leaving the spout has a maximum hot temperature, and a plurality of intermediate positions between the second position and the third position, wherein each intermediate positions between the first position and the second position, wherein each intermediate position corresponds to a temperature that is between the maximum cold and the maximum hot temperatures.

20. The faucet of claim 19, further comprising a sensor that is located on or in the tray and configured to turn on and off the flow of water from the spout upon detection of an object in a zone of detection of the sensor, and wherein the lever is located on a lateral side of the body or the tray that is substantially orthogonal to the front side of the body.

* * * * *